US005542122A

United States Patent [19]

Moldovan

[11] Patent Number: 5,542,122

[45] Date of Patent: Aug. 6, 1996

[54] ORNAMENTAL FEATURE WITH APPAREL OR CARRYING ARTICLE

[76] Inventor: Jack Moldovan, 7368 Melrose Ave., Los Angeles, Calif. 90046

[21] Appl. No.: 505,105

[22] Filed: Jul. 21, 1995

[51] Int. Cl.[6] ..... A41D 1/00

[52] U.S. Cl. ..... 2/69; 2/115; 2/244; 2/246

[58] Field of Search ..... 2/69, 115, 108, 2/244, 1, 90, 106, 80, 246, 247, 249, 250; 224/101, 153; 40/586; D2/733, 734, 741, 745, 764, 772, 776, 777, 784, 786, 787, 788, 789, 810, 818, 820, 897–900, 982

[56] References Cited

U.S. PATENT DOCUMENTS

| | | | |
|---|---|---|---|
| 2,628,452 | 5/1953 | Gladstein | 2/247 |
| 4,120,053 | 10/1978 | Nemirofsky | 2/115 |
| 4,591,521 | 5/1986 | Freno et al. | 2/115 |
| 4,710,979 | 12/1987 | Bull et al. | 2/48 |
| 4,772,503 | 9/1988 | Donsky . | |
| 4,815,149 | 3/1989 | Erhardt et al. . | |
| 4,838,965 | 6/1989 | Bussard | 2/115 |
| 4,975,987 | 12/1990 | Teachout et al. | 2/246 |
| 4,980,929 | 1/1991 | Long . | |
| 5,079,778 | 1/1992 | Sloot | 2/115 |
| 5,117,507 | 6/1992 | Long . | |
| 5,136,726 | 8/1992 | Kellin et al. | 2/115 |
| 5,169,701 | 12/1992 | Sander . | |
| 5,210,881 | 5/1993 | Stocker, Jr. et al. | 2/115 |
| 5,274,848 | 1/1994 | Shamblin . | |

FOREIGN PATENT DOCUMENTS

| | | | |
|---|---|---|---|
| WO8802605 | 4/1988 | WIPO | 2/244 |

*Primary Examiner*—C. D. Crowder
*Assistant Examiner*—Gloria Hale
*Attorney, Agent, or Firm*—Merchant, Gould, Smith, Edell, Welter & Schmidt

[57] ABSTRACT

An apparel article in the nature of clothing or a backpack which includes a first fabric material onto which is sewn, at least in part, a stuffed animal as an ornamental feature. The animal may be removable or may be at least partially stitched onto the first fabric. The location of the animal can be on the shoulder of a garment or the top arm portion such that the animal appears to perch or hug onto the body of a wearer of the article.

21 Claims, 3 Drawing Sheets

ORNAMENTAL FEATURE WITH APPAREL OR CARRYING ARTICLE

BACKGROUND

Having a clothing article or carrying article with a striking self contained ornamental features is highly desirable.

This invention relates to an apparel article, such as clothing, and a carrying article, such as a bag, in the nature, for instance, of a backpack.

It is well-known to provide on such articles ornamental features such as buttons and bows, and also to embroider or print desired patterns on these articles.

Different toys in the form, for instance, of animals or cartoon characters, are also well-known. In many cases, it is known to imprint animal characters or the like on apparel articles.

Despite all the multiple techniques for imprinting ornamentation on apparel items, it is not known to have toys cooperate with apparel articles or carrying articles in a unique and attractive manner.

There accordingly exists a need to provide apparel articles in the nature of clothing or carrying items, together with toys.

SUMMARY

By this invention, the Applicant provide an article to be carried on or by the body, in the nature of an apparel article or a backpack or bag item, which has unique advantages.

According to the invention, there is provided an apparel article, in the nature of clothing, which includes a first fabric material. There is an ornamental feature which is self-contained and which has a second fabric material which is affixed, at least in part, to the first material.

The ornamental feature is raised relative to a first surface formed by the first fabric thereby to create a three-dimensional effect. In some forms of the invention a pliable stuffing is located between the first fabric material and second fabric material such that the ornamental feature is pliable and as the first material adopts different positions on the body, the ornamental feature is likewise relatively pliable.

In a preferred form of the invention, the feature is in the form of a stuffed animal or toy, and a pliable stuffing is located within the second fabric material such that the ornamental feature is a self-contained pliable feature. The second fabric is of a form and color such that the stuffed animal realistically is representative of an animal in a natural state. Suitable means is provided to attach the feature to the first fabric material.

In a further preferred form of the invention, the location of the first surface is on or adjacent to the shoulder or top arm portion of an article of clothing, such as a shirt or jacket. In this manner, the ornamental feature such as an animal appears to perch on or hug the shoulder or arm, respectively, of a wearer of the clothing. In other cases, the apparel article may be trousers, jeans, shorts or the like. As such the first material covers either the upper or lower portion of the human body.

A different form of the invention includes a carrying article in the form of a backpack or lunch pack. The ornamental feature adheres to the pack at a strategically located position. In other cases, the carrying item may be a bag in the form of luggage or the like.

The invention is further described with reference to the accompanying drawings.

DRAWINGS

FIG. 1 is a perspective view of part of a shirt showing an ornamental feature on the shoulder.

FIG. 2 a partial perspective view of a shirt with ornamental features on a sleeve and in a pocket.

DESCRIPTION

Figure 1:
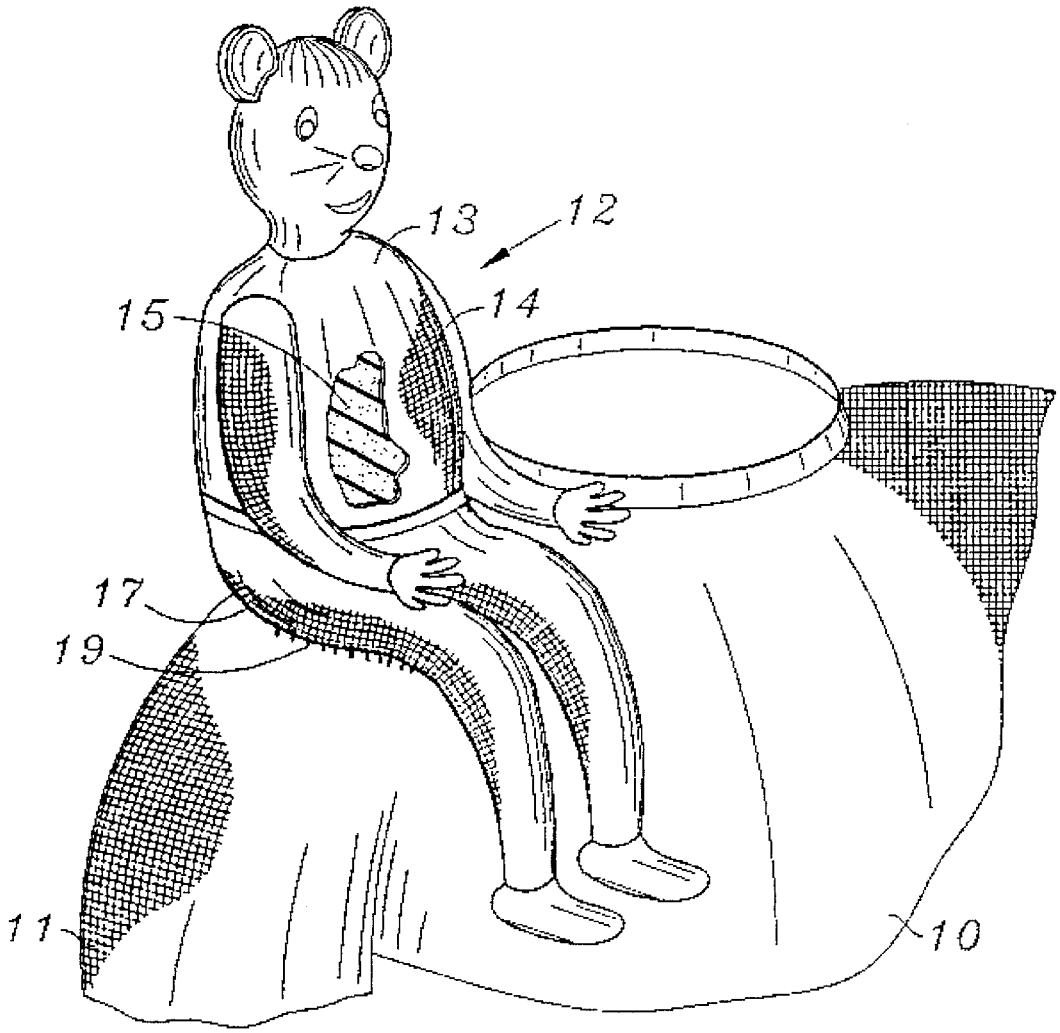

In FIG. 1, there is shown an apparel article, namely portion of shirt. It comprises a surface 10 to cover at least part of the human body. The surface 10 is formed, at least in part, of a first cloth material or fabric 11. In some cases it may be leather or a polyester non-woven material. Preferably, the first material is a woven fabric. There is a self-contained ornamental feature 12, namely a mouse, having a surface 13 and being of a second fabric or cloth material 14.

Figure 6:
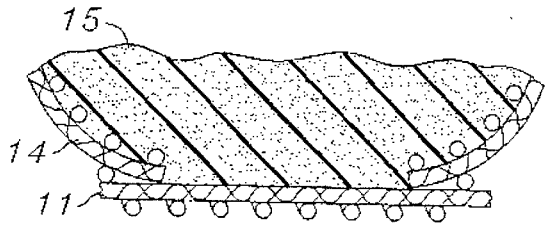
FIG. 6 is a partial view showing a cross-section of the shirt, ornamental feature and means for affixing them together.

The ornamental feature 12 is raised relative to the surface 10 of the first cloth material 11, thereby to provide a three-dimensional effect. Inside the surface 13 there is a pliable stuffing 15. In the FIG. 1 embodiment, there is no second material other than, at the interengaging position 17 which engages with the first surface 10. This is shown in FIG. 6. Thus, the pliable material 15 is bordered in part by the first cloth material 11 and the second material 14.

Effectively, there is pliable material 15 between the first cloth material 11 and the second cloth material 14. The stuffing may be any material that usually fills the inside of stuffed or plush toys so long as it is pliable. It could be a cotton waste or other filling. It is ideally a washable material so that the feature can be washed and dried as the garment is washed and dried. In this manner, the ornamental feature is pliable as the first cloth material 11 adopts a different position on the body. This is illustrated in FIGS. 3–6.

Figure 3:
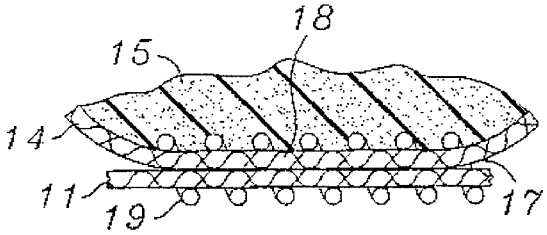
FIG. 3 is a partial view showing a cross-section of the shirt, ornamental feature and means for affixing them together.
Figure 4:
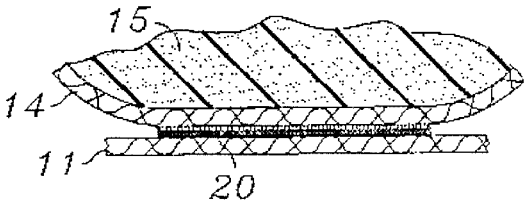
FIG. 4 is a partial view showing a cross-section of the shirt, ornamental feature and means for affixing them together.
Figure 5:
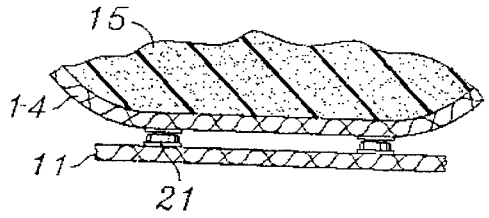
FIG. 5 is a partial view showing a cross-section of the shirt, ornamental feature and means for affixing them together.

As illustrated in FIGS. 3, 4 and 5, the second material embraces the feature 12. There is thus a portion 18 of the second material 14 which is interleaved between the first surface 10 and the pliable material 15. The feature 12 in this manner is self-contained and separable from the apparel while as required. The feature 12 is totally enclosed by the second material 14.

As illustrated, the first cloth material 11 forms a covering for the upper body, and as such is in the nature of a shirt or jacket. In other cases, the apparel article is for the lower portion of the body and could be trousers, jacket or jeans.

In the shirt embodiment, the ornamental feature 12 is affixed to the first material 11 at a portion corresponding to the vicinity of a shoulder portion for the human body as shown in FIG. 1. The ornamental feature 12 appears at least over the shoulder of a portion of the garment whereby the shoulder portion of the garment appears to act as a perch to support the ornamental feature 12.\

Figure 2:
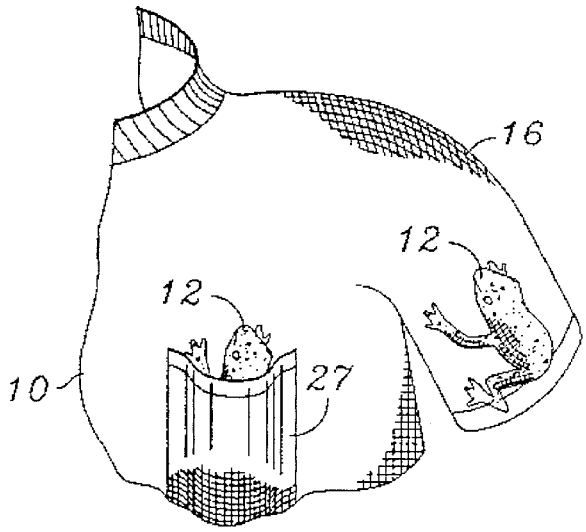

A different arrangement can have the ornamental feature 12 affixed to a sleeve portion 16 of a garment, whereby the ornamental feature 12 appears to hug onto an arm of a wearer of the garment. This is illustrated in FIG. 2. In this embodiment, the feature 12 is also shown appearing to sit in a pocket 27 of the shirt.

The ornamental feature 12 is preferably a self-contained stuffed animal. The second cloth material 14 provides a covering for the stuffed animal, and is of a nature and texture such that the animal is a rendering of a natural animal in color, shape and appearance.

In the embodiment of FIGS. 1, 2, 3 and 6, the ornamental feature 12 is affixed to the first surface material 10 by means of stitching 19. The stitching 19 is effected at least partially about a perimeter 17 of the ornamental feature 12.

In other embodiments, the ornamental feature 12 is at least partly separable from the first cloth material 11. The ornamental feature 12 is removably affixed to the first surface material 11. These versions are shown in FIGS. 4 and 5. In FIG. 4, there is a Velcro™ feature 20 of hooks and loops for effecting the affixation. In FIG. 5, there are press buttons 21.

Figure 7:
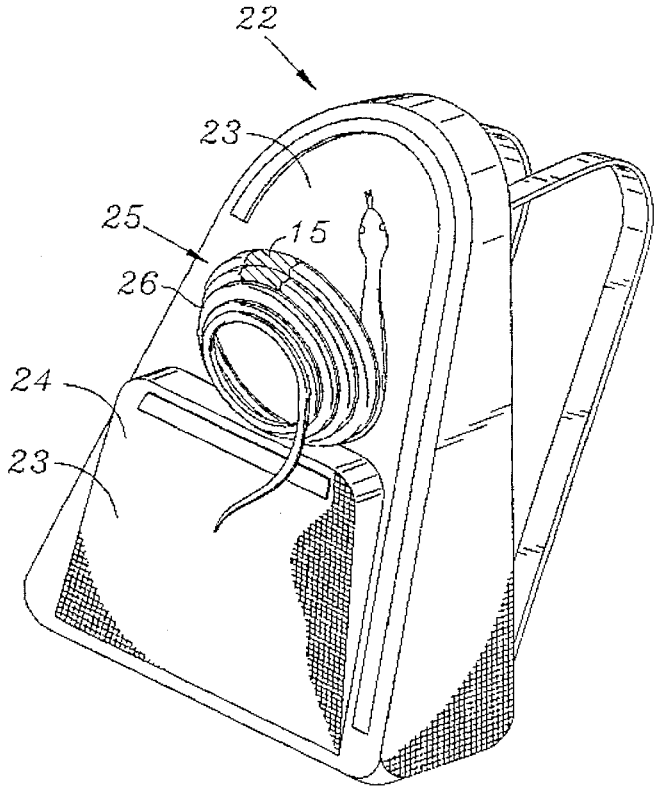
FIG. 7 is a rear view of a backpack with an ornamental feature.

As shown in FIG. 7, there is an article 22 for carrying by a person. This article 22 is in the nature of backpack or lunch pack. There is a surface 23 for carriage on or by at least part of the human body. The surface is formed of a first material 24. There is also an ornamental feature 25 having a surface of a second material 26. The ornamental feature 25 is for affixation to part of the first material 24. The ornamental feature 25 is raised relative to the surface of the first material 24 thereby to provide a three-dimensional effect.

There is a pliable stuffing 15 between the first material 24 and the second material 26. As such, the ornamental feature 25 is pliable as the first material 24 adopts a different carriage position on or relative to the body. Similar affixation means can be provided to ensure engagement of the first surface and the second surface as described with regard to the apparel article.

Many other forms of the invention exist, each differing from the other in matters of detail only.

Although the invention has been described in terms of a stuffed animal or plush toy for location on the shoulder, the ornamental feature may be some other form of decorative element which is pliable relative to the surface due to the existence of a pliable material between the first material and the second material.

The pliable material may be wool or some other synthetic stuffing material which is conventionally used for stuffing soft or plush animals.

The stuffed animal may be affixed to the first material in any other manner, for instance, snap features. This would make the stuffed animal easily removable for washing separately from the first fabric and for separate usage as a toy. When removed from the first fabric, the fabric retains its function as an article of apparel or as a carrying article.

The invention is to be determined by the following claims.

What is claimed is:

1. An apparel article comprising:

a surface to cover at least part of the human body, the surface being formed, at least in part, of a first material, a three-dimensional ornamental feature having a surface of a second material, the ornamental feature being for affixation to part of the first material, the ornamental feature being raised relative to the surface of the first material thereby to provide the three-dimensional effect, the ornamental feature including an imprinted or embroidered material which is affixed to the first material, the feature being encased substantially totally by the second material, pliable washable stuffing within the encasing second material such that the three-dimensional ornamental feature is pliable as the first material adopts a different position on the body, the washable characteristic permitting pliability after washing, and the ornamental feature being affixed to the first surface material by means of stitching, the stitching being effected only partially about substantially the perimeter of the ornamental feature so that the feature can be raised from the first material where there is no perimeter stitching, the ornamental feature being permanently attached to the first material through the stitching, and the surface of the first material forming an unbroken base underneath the ornamental feature.

2. An apparel article as claimed in claim 1 wherein the first material forms a covering for the upper body, and the ornamental feature is affixed to the first material at a portion corresponding to the vicinity of a shoulder portion for the human body.

3. An apparel article as claimed in claim 1 wherein the ornamental feature is a stuffed animal.

4. An apparel article as claimed in claim 3 wherein the second material is a cloth material covering for the stuffed animal, and wherein the animal is a rendering of a natural animal in color, shape and appearance.

5. An apparel article as claimed in claim 2 wherein the ornamental feature is affixed over the shoulder portion of a garment whereby the shoulder portion of the garment appears to act as a perch to support the ornamental feature.

6. An apparel article as claimed in claim 1 wherein the ornamental feature is affixed to a sleeve portion of a garment, wherein the ornamental feature appears to hug on an arm of a wearer of the garment.

7. An apparel article comprising:

a surface to cover at least part of the human body, the surface being formed, at least in part, of a first material, an ornamental three-dimensional stuffed animal feature having a surface of a second material, the ornamental feature being for affixation to part of the first material the ornamental feature being raised relative to the surface of the first material thereby to provide the three-dimensional effect, the feature being encased substantially totally by the second material, and wherein the second material is an imprinted or embroidered covering for the stuffed animal, and wherein the animal is a rendering of a natural animal in at least one of color or shape, pliable washable stuffing within the encasing second material such that the ornamental feature is pliable as the first material adopts a different position on the body, the washable characteristic permitting pliability after washing, and the ornamental feature being affixed to the first surface material by means of stitching, the stitching being effected only partially about substantially the perimeter of the ornamental feature so that the feature can be raised from the first material where there is no perimeter stitching, and the surface of the first material forming an unbroken base underneath the ornamental feature.

8. An apparel article as claimed in claim 7 wherein the animal feature is located at least over the shoulder portion of a garment whereby the shoulder portion of the garment appears to act as a perch to support the ornamental feature.

9. An apparel article as claimed in claim 7 wherein the animal feature is affixed to a sleeve portion of a garment, wherein the ornamental feature appears to hug on an arm of a wearer of the garment.

10. An article for carrying by a person comprising:

a surface for carriage by the human body, the surface being formed of a first material, an ornamental feature having a surface of a second material, the ornamental feature being three-dimensional and for affixation to part of the first material, the ornamental feature being raised relative to the surface of the first material thereby to provide a three-dimensional effect, the ornamental feature including an imprinted or embroidered material which is affixed to the first material, the feature being encased substantially totally by the second material, pliable washable stuffing within the encasing second material such that the ornamental feature is pliable as the first material adopts a different position, the washable characteristic permitting pliability after washing, and the ornamental feature being permanently affixed to the first surface material by means of stitching, the stitching being effected only partially about substantially the perimeter of the ornamental feature so that the feature can be raised from the first material where there is no perimeter stitching, and the surface of the first material forming an unbroken base underneath the ornamental feature.

11. An article as claimed in claim 10 wherein the surface forms part of clothing, the clothing being selectively for location on an upper portion or a lower portion of a human body.

12. An article as claimed in claim 10 wherein the surface forms part of a bag for carrying possessions, the bag being selectively a backpack or a lunch pack.

13. An apparel article comprising:

a surface to cover at least part of the human body, the surface being formed, at least in part, of a first material, a three-dimensional ornamental feature having a surface of a second material, the ornamental feature being for affixation to part of the first material, the ornamental feature being raised relative to the surface of the first material thereby to provide the three-dimensional effect, the ornamental feature including an imprinted or embroidered material which is affixed to the first material, the feature being encased substantially totally by the second material, pliable washable stuffing within the encasing second material such that the three-dimensional ornamental feature is pliable as the first material adopts a different position on the body, the washable characteristic permitting pliability after washing, and the ornamental feature being affixed to the first surface material by means of stitching, the stitching being effected at least partially about substantially the perimeter of the ornamental feature, the ornamental feature being permanently attached to the first material through the stitching, and the surface of the first material forming an unbroken base underneath the ornamental feature.

14. An apparel article comprising:

a surface to cover at least part of the human body, the surface being formed, at least in part, of a first cloth material, an ornamental three-dimensional stuffed animal feature having a surface of a second cloth material, the ornamental feature being for affixation to part of the first cloth material, the ornamental feature being raised relative to the surface of the first cloth material thereby to provide the three-dimensional effect, the feature being encased substantially totally by the second material, and wherein the second cloth material is an imprinted or embroidered covering for the stuffed animal, and wherein the animal is a rendering of a natural animal in at least one of color or shape, pliable washable stuffing within the encasing second cloth material such that the ornamental feature is pliable as the first cloth material adopts a different position on the body, the washable characteristic permitting pliability after washing, and the ornamental feature being affixed to the first surface material by means of stitching, the stitching being effected at least partially about substantially the perimeter of the ornamental feature and the surface of the first material forming an unbroken base underneath the ornamental feature.

15. An article for carrying by a person comprising:

a surface for carriage by the human body, the surface being formed of a first material, an ornamental feature having a surface of a second material, the ornamental feature being three-dimensional and being for affixation to part of the first material, the ornamental feature being raised relative to the surface of the first material thereby to provide a three-dimensional effect, the ornamental feature including an imprinted or embroidered material which is affixed to the first material, the feature being encased substantially totally by the second material, pliable washable stuffing within the encasing second material such that the ornamental feature is pliable as the first material adopts a different position, the washable characteristic permitting pliability after washing, and the ornamental feature being permanently affixed to the first surface material by means of stitching, the stitching being effected at least partially about substantially the perimeter of the ornamental feature, and the surface of the first material forming an unbroken base underneath the ornamental feature.

16. An article as claimed in claim 1 wherein the ornamental feature is located at least partly in and protrudes at least partly from a pocket of a garment.

17. An article as claimed in claim 7 wherein the ornamental feature is located at least partly in and protrudes at least partly from a pocket of a garment.

18. An article as claimed in claim 10 wherein the ornamental feature is located at least partly in and protrudes at least partly from a pocket of a garment.

19. An article as claimed in claim 13 wherein the ornamental feature is located at least partly in and protrudes at least partly from a pocket of a garment.

20. An article as claimed in claim 14 wherein the ornamental feature is located at least partly in and protrudes at least partly from a pocket of a garment.

21. An article as claimed in claim 15 wherein the ornamental feature is located at least partly in and protrudes at least partly from a pocket of a garment.

* * * * *

UNITED STATES PATENT AND TRADEMARK OFFICE

CERTIFICATE OF CORRECTION

PATENT NO. : 5,542,122

DATED : August 6, 1996

INVENTOR(S) : Jack Moldovan

It is certified that error appears in the above-identified patent and that said Letters Patent is hereby corrected as shown below:

Column 1, line 29, delete "provide" and insert --provides--.

Column 3, line 4, delete "\" after the numeral "12."

Column 3, line 66, after the word "surface" insert --of a second material, the ornamental feature being for--.

Signed and Sealed this

Eleventh Day of March, 1997

*Attest:*

*Attesting Officer*

BRUCE LEHMAN

*Commissioner of Patents and Trademarks*